US010865972B2

(12) United States Patent
Yellin et al.

(10) Patent No.: US 10,865,972 B2
(45) Date of Patent: Dec. 15, 2020

(54) PHOTOGRAPHIC LIGHTING DEVICE

(71) Applicant: SUMOLIGHT GMBH, Berlin (DE)

(72) Inventors: David Yellin, Berlin (DE); Ralf Polaczek, Berlin (DE)

(73) Assignee: SUMOLIGHT GMBH, Berlin (DE)

( * ) Notice: Subject to any disclaimer, the term of this patent is extended or adjusted under 35 U.S.C. 154(b) by 0 days.

(21) Appl. No.: 14/405,052

(22) PCT Filed: Jun. 3, 2013

(86) PCT No.: PCT/DE2013/100197
§ 371 (c)(1),
(2) Date: Dec. 2, 2014

(87) PCT Pub. No.: WO2013/178222
PCT Pub. Date: Dec. 5, 2013

(65) Prior Publication Data

US 2015/0146404 A1 May 28, 2015

(30) Foreign Application Priority Data

Jun. 1, 2012 (DE) ..... 10 2012 104 779

(51) Int. Cl.
*F21V 29/70* (2015.01)
*F21V 7/16* (2006.01)
(Continued)

(52) U.S. Cl.
CPC ..... *F21V 29/70* (2015.01); *F21V 1/06* (2013.01); *F21V 7/16* (2013.01); *F21V 7/18* (2013.01);
(Continued)

(58) Field of Classification Search
CPC ..... F21V 29/02; F21V 29/60; F21V 29/81; F21V 29/80; F21W 2131/406
(Continued)

(56) References Cited

U.S. PATENT DOCUMENTS 2,278,720 A * 4/1942 Follet ..... F21V 21/26 285/264
3,278,203 A * 10/1966 Snyder ..... F21V 21/30 285/138.1
(Continued)

FOREIGN PATENT DOCUMENTS

CN 101373061 A 2/2009
CN 101592295 A 12/2009
(Continued)

OTHER PUBLICATIONS

International Search Report for PCT Application No. PCT/DE2013/100197, International Filing Date: Jun. 3, 2013; 3 pgs.
(Continued)

*Primary Examiner* — Alexander K Garlen
*Assistant Examiner* — Colin J Cattanach
(74) *Attorney, Agent, or Firm* — Schtneiser, Olsen & Watts, LLP

(57) ABSTRACT

A lighting device, comprising a housing, a planar arrangement of lamps, which are arranged in the housing, and a plate device, which is received on the housing, wherein a housing rear wall is formed by the plate device, the plate device has a circuit board, on which an electric circuit associated with the lamps is arranged, and the plate device has a heat sink device for passive cooling, which is formed by pin-type cooling elements is provided. The application also relates to a headlight.

11 Claims, 8 Drawing Sheets

Figure 1:
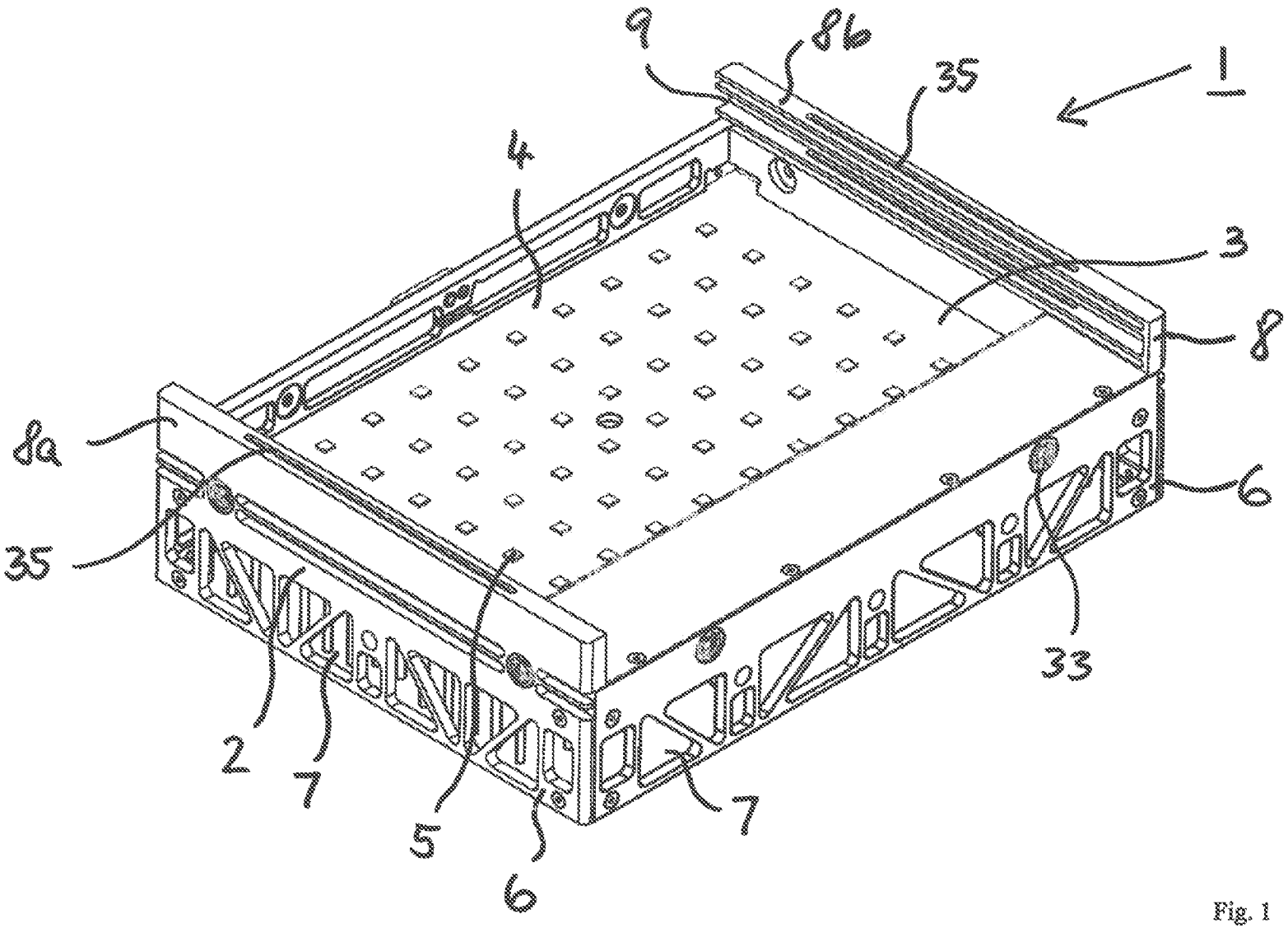

(51) Int. Cl.

| | |
|---|---|
| ***F21V 7/18*** | (2006.01) |
| ***F21V 1/06*** | (2006.01) |
| ***F21V 29/81*** | (2015.01) |
| ***F21V 29/80*** | (2015.01) |
| ***F21V 29/60*** | (2015.01) |
| ***F21Y 115/10*** | (2016.01) |
| ***F21Y 105/16*** | (2016.01) |
| ***F21W 131/406*** | (2006.01) |

(52) U.S. Cl.
CPC ..... *F21V 29/60* (2015.01); *F21V 29/80* (2015.01); *F21V 29/81* (2015.01); *F21W 2131/406* (2013.01); *F21Y 2105/16* (2016.08); *F21Y 2115/10* (2016.08)

(58) Field of Classification Search
USPC ..... 362/3, 11, 18
See application file for complete search history.

(56) References Cited

U.S. PATENT DOCUMENTS 4,757,425 A * 7/1988 Waltz ..... G03B 15/06 362/18
5,311,409 A * 5/1994 King ..... G03B 15/06 362/17
5,845,885 A * 12/1998 Carnevali ..... F16M 11/14 248/181.1
6,164,801 A * 12/2000 Alexander-Katz ..... F21V 21/40 362/1
6,269,003 B1 * 7/2001 Wen-Chen ..... H01L 23/3672 165/80.3
6,347,776 B1 * 2/2002 Chuang ..... F16M 11/14 248/288.51
6,422,709 B1 * 7/2002 Panagiotou ..... F21V 17/164 362/16
7,341,362 B2 * 3/2008 Bjornson ..... A61N 5/062 362/235
RE42,060 E * 1/2011 Carnevali ..... F16M 11/14 248/181.1
7,974,099 B2 * 7/2011 Grajcar ..... H05K 1/0204 257/718
7,993,031 B2 * 8/2011 Grajcar ..... F21V 21/00 362/294
8,313,203 B1 * 11/2012 Guiney ..... G03B 15/02 362/18
8,864,326 B2 * 10/2014 Armer ..... F21V 9/083 362/6
2003/0063462 A1 * 4/2003 Shimizu ..... H01L 25/0753 362/230
2003/0128542 A1 * 7/2003 Pohlert ..... F21K 9/65 362/253
2004/0120152 A1 * 6/2004 Bolta ..... F21V 5/002 362/294
2005/0225959 A1 * 10/2005 Pohlert ..... H04N 5/2354 362/3
2005/0231948 A1 * 10/2005 Pohlert ..... F21V 14/06 362/237
2006/0126319 A1 * 6/2006 Pohlert ..... H04N 5/2354 362/11
2006/0152933 A1 * 7/2006 Kramer ..... F21S 2/00 362/382
2007/0076381 A1 * 4/2007 Han ..... F21K 9/00 361/749
2007/0217772 A1 * 9/2007 Lemelson ..... G03B 15/02 396/4
2007/0230185 A1 * 10/2007 Shuy ..... B60Q 1/20 362/294
2008/0068839 A1 * 3/2008 Matheson ..... F21S 2/005 362/249.07
2008/0087911 A1 4/2008 Stoyan
2008/0101067 A1 * 5/2008 Cariboni ..... F21V 5/04 362/245
2008/0117637 A1 * 5/2008 Chang ..... F21V 29/004 362/294
2008/0191219 A1 * 8/2008 Villard ..... F21K 9/00 257/88
2008/0230667 A1 * 9/2008 Chapman ..... F16M 11/14 248/279.1
2008/0296589 A1 * 12/2008 Speier ..... H01L 33/642 257/82
2009/0002946 A1 * 1/2009 Horng ..... F21V 29/02 361/697
2009/0109617 A1 * 4/2009 Grajcar ..... H05K 1/0204 361/688
2009/0161339 A1 * 6/2009 Gonzalez ..... G03B 15/02 362/16
2009/0180290 A1 * 7/2009 Grajcar ..... F21V 29/80 362/373
2009/0194251 A1 * 8/2009 Wei ..... F21V 29/004 165/67
2009/0296412 A1 * 12/2009 Ogawa ..... F21S 8/043 362/373
2010/0027276 A1 * 2/2010 Kornitz ..... F21V 29/02 362/373
2010/0096993 A1 * 4/2010 Ashdown ..... F21V 29/004 315/113
2010/0097799 A1 * 4/2010 Shin ..... F21V 29/004 362/235
2010/0128479 A1 * 5/2010 Biebl ..... F21K 9/00 362/249.02
2010/0128483 A1 * 5/2010 Reo ..... F21S 8/038 362/294
2010/0210918 A1 * 8/2010 Dunn ..... A61B 19/5202 600/249
2010/0264826 A1 * 10/2010 Yatsuda ..... F21K 9/00 315/112
2010/0308707 A1 * 12/2010 Ku ..... F21K 9/00 313/46
2011/0114977 A1 * 5/2011 Miura ..... F21V 15/013 257/91
2011/0156587 A1 * 6/2011 Wu ..... F21V 23/02 315/35
2011/0188203 A1 * 8/2011 Smith ..... F21V 29/02 361/699
2011/0194258 A1 * 8/2011 Kodadek, III ..... F21V 29/02 361/720
2011/0198068 A1 * 8/2011 Chen ..... H01L 23/3672 165/185
2012/0061070 A1 3/2012 Kornitz et al.
2012/0063116 A1 * 3/2012 Baxter ..... F21V 5/045 362/6
2012/0069566 A1 3/2012 Huang et al.
2012/0163003 A1 * 6/2012 Lee ..... F21V 29/004 362/382
2012/0325982 A1 * 12/2012 Guercio ..... F21V 31/005 248/65
2013/0120973 A1 * 5/2013 Chen ..... F21V 29/2287 362/147
2013/0208443 A1 * 8/2013 Pearsall ..... F21V 9/16 362/84

FOREIGN PATENT DOCUMENTS

| | | | |
|---|---|---|---|
| CN | 101646898 | A | 2/2010 |
| CN | 102116423 | A | 7/2011 |
| DE | 202006015506 | U1 | 1/2007 |
| DE | 2020060154506 | U1 | 1/2007 |
| DE | 202009017596 | U1 | 3/2010 |
| EP | 2341282 | A1 | 7/2011 |
| WO | 2011109765 | A2 | 9/2011 |

OTHER PUBLICATIONS

Written Opinion for PCT Application No. PCT/DE2013/100197, International Filing Date: Jun. 3, 2013; 4 pgs.

(56) References Cited

OTHER PUBLICATIONS

English translation of Chinese Office Action for Chinese Application No. 201380030935.8, dated Jul. 5, 2017.

* cited by examiner 15
16
17
18
19
20

PHOTOGRAPHIC LIGHTING DEVICE

CROSS-REFERENCE TO RELATED APPLICATIONS

This application claims priority to PCT Application No. PCT/DE2013/100197, having a filing date of Jun. 3, 2013, based on DE 10 2012 104 779.0, having a filing date of Jun. 1, 2012, the disclosure of both are herewith incorporated by reference in their entireties.

FIELD OF TECHNOLOGY

The following relates to a lighting device and also to a headlight, in particular headlight for recording video or shooting photos.

BACKGROUND

Lighting devices are routinely used to illuminate or light up objects, spaces or the like. They normally have a housing and lamps, which are received in the housing and which output light when an electric voltage is applied A particular form of lighting devices is constituted by studio or camera headlights, which are configured as lighting devices to provide light for photo shooting or video recording. Particular requirements are routinely placed on such headlights in order to meet the light conditions necessary for photo shooting or video recording. On the one hand, the light must have sufficient light intensity. The headlights should also enable long-term recording and shooting. Known lighting devices meet the diverse requirements only inadequately in the different situations of use.

SUMMARY

An aspect relates to a lighting device which can be used in a versatile manner in different situations of use, in particular also for mobile applications. To this end, the mechanical and electrical structure of the lighting device is to be optimised. The lighting device is to be suitable in particular for use in photo shooting and video recording.

This aspect is achieved by a lighting device according to the claims. Furthermore, a headlight according to the claims is created. Preferred embodiments are specified by dependent claims.

A lighting device comprising a housing, a planar arrangement of lamps, which are arranged in the housing, and a plate device, which is received on the housing, is created. A housing rear wall is formed by the plate device. The plate device has a circuit board, on which an electric circuit associated with the lamps is arranged. Furthermore, the plate device has a heat sink device for passive cooling, said heat sink device being formed with pin-type cooling elements.

A headlight, in particular for recording video or shooting photos, comprising such a lighting device is also created.

The lighting device has a function-optimised housing design. A multifunctional component of the lighting device is thus created with the plate device and is configured to provide a number of functions. On the one hand, the rear wall for the housing is formed by the plate device. Furthermore, the plate device has a circuit board, on which an electric circuit arrangement for the lamps is arranged. Lastly, the plate device also provides a cooling function since it has a heat sink device for passive cooling.

The circuit board preferably extends in the plane of the plate device, wherein the circuit board may substantially cover the entire area of the plate device forming the housing rear wall.

Electric operating elements of the lighting device, for example one or more switches and/or a dimming device, can be housed partially or completely on the front side of the circuit board with the lamps. This supports an airflow onto the rear side that is unhindered to the greatest possible extent. Some of the operating elements may protrude through the circuit board with the lamps and may thus be operated from the rear side. At least some of the electric operating elements can be housed on the circuit board with the lamps. To this end, the circuit board can be configured as a multi-layer circuit board.

The pin-type cooling elements form a planar arrangement of cooling elements, wherein the pin-type cooling elements can be distributed over the area in accordance with a uniform distribution. The pin-type cooling elements may extend substantially over the entire rear wall region. The heat sink device in this respect forms a passive cooling device in whole or in part.

A convective pin arrangement can be formed with the pin-type cooling elements, said arrangement being formed to provide convective heat dissipation. The pin-type cooling elements can be arranged so as to be exposed, that is to say not shielded by the housing parts with respect to the surrounding environment, in particular on the rear side of the housing.

In accordance with a development, the lamps are each configured as LED luminaires. The circuit board can be fitted with the LED luminaires and/or other lamps. In one embodiment, the arrangement of the lamps comprises at least 60 LED luminaires, which for example have a power of at least approximately 3 watts. In one embodiment, the arrangement of lamps comprises LED luminaires of at least one first LED luminaire type and one second LED luminaire type, wherein the first and the second LED luminaire type differ in terms of at least one operating parameter. For example, daylight LED luminaires and also artificial light LED luminaires can be included in the arrangement of the lamps. The light of the different LED luminaire types then mixes during operation. The contribution of the different LED luminaire types to the light output can be controlled continuously in a specific operating situation. For example, the artificial light and the daylight proportion can thus be adjusted depending on the application. White-light LEDs are preferably used. For light generation, blue LED luminaires with a phosphor plate arranged in front for light colour conversion can be used. LED luminaires in which the light-converting phosphor layer is part of the LED luminaire itself can also be used. In one embodiment, the lighting device has a mobile energy supply, with which battery operation is made possible.

In one embodiment, the heat sink device may have a base plate, on which the pin-type cooling elements are arranged on the rear side. The pin-type cooling elements are thermally conductively connected to the base plate, such that heat produced at the base plate can be transferred to the pin-type cooling elements and can then be delivered from there to the surrounding environment.

In accordance with one embodiment, the base plate is formed separately from the circuit board and is arranged in the plate device on the rear side relative to the circuit board. In this embodiment, the base plate forms a type of support plate for the pin-type cooling elements. The base plate may be attached to the plate device by means of adhesive bonding, for example on the rear side of the circuit board, wherein the base plate is thermally coupled directly or indirectly to the circuit board via one or more intermediate layers.

In accordance with a development, the circuit board preferably forms the base plate. In this embodiment the pin-type cooling elements are arranged on the circuit board itself. The pin-type cooling elements are preferably coupled thermally to a cooling core of the circuit board.

In one embodiment, the pin-type cooling elements may be configured in accordance with at least one of the following designs: adhesively bonded pin-type elements, welded pin-type elements, soldered pin-type elements and press-fitted pin-type elements. In the embodiment of the pin-type cooling elements as adhesively bonded pin-type elements, a heat-resistant adhesive is preferably used in order to fasten the pin-type cooling elements in the heat sink device. A heat-conducting adhesive can be used as adhesive. Such a heat-conducting adhesive can also be used to receive the above-explained support plate with the pin-type cooling elements in the plate device in an adhesively bonded manner. The pin-type cooling elements may in turn have different cross-sectional shapes, including round or angular cross-sectional shapes. The pin-type elements have a pin base, which is then arranged on the base plate or in an associated recess in the base plate. In one embodiment, the pin base has the same circumference as the pin body arranged thereabove. However, the pin base may also have a larger or smaller cross-sectional area than the pin body arranged thereabove. The pin base is preferably received in an associated recess in the base plate in a form-fitting manner. The pin-type cooling elements for example may have a pin length between approximately 30 mm and approximately 40 mm, preferably of approximately 35 mm. The diameter of the pin-type cooling elements is preferably between approximately 2.5 mm and approximately 3.5 mm, preferably approximately 3 mm. The mutual distance between adjacent pin-type cooling elements may be, for example, approximately 9 mm to approximately 10 mm, preferably approximately 9.5 mm.

In accordance with a development, the circuit board may have a cooling core made of metal. The pin-type cooling elements are thermally coupled to the cooling core. In this or other embodiments, the circuit board may be bevelled at the sides thereof or bent over, such that the bevelled regions of the circuit board simultaneously form a housing portion partially or completely. By way of example, an aluminium circuit board can be used, which has a cooling core made of aluminium. The cooling pin-type elements can be received on the circuit board such that they are coupled thermally to the cooling core directly or indirectly. There may be direct contact between the cooling pin-type elements and the cooling core.

In accordance with a development, an active cooling device that is suitable for creating a forced fluid flow through the pin-type cooling elements is provided. The active cooling device can be arranged to the side of the arrangement of cooling pin-type elements, preferably on the rear side of the plate device. For active cooling, one or more fans can be used. The active cooling device can be arranged on the circuit board. Preferably, one or more fans can be used which are suitable for generating a forced fluid flow, in particular an airflow, through the pin-type cooling elements with high air volume and low air pressure. Fans of this type are volume-optimised fans in this respect. A fan may have one or more of the following technical parameters: 700 rpm (rpm=rotation per minute), 60 cubic metres/h, 6.8 db and a static pressure of 0.44 mmH20. A highly optimised "impeller" with bevelled blade tips can be used.

In accordance with one embodiment, the arrangement of lamps can be configured to output light having a colour rendering index of at least approximately 90, preferably of at least approximately 95. The colour rendering index (CRI) is a photometric variable, with which the quality of the colour rendering of light sources of identical correlated colour temperature is described. Up to a colour temperature of 5000K, the light that is output by a black emitter of the corresponding temperature is used as a reference for the assessment of the rendering quality. Above 5000K, spectral distribution similar to daylight is referenced. The colour rendering index is not dependent on a certain colour temperature. Any light source that correctly reproduces the spectrum of a black emitter of identical (correlated) colour temperature in the visible wavelength range achieves a colour rendering index of 100. Spectral components outside visible light remain unconsidered.

In accordance with one embodiment, the arrangement of lamps is assigned a dimming device, with which the lamps can be dimmed analogously. An analogous diming provides a possibility for continuous control. The dimming device can be at least part of the electric circuit of the lamps on the circuit board.

In accordance with a development, the arrangement of lamps is assigned a temperature measurement device, with which an operating temperature of the lamps can be measured. The temperature measurement device can be coupled to a control device, which controls the voltage supply for the lamps depending on the measured operating temperature. By way of example, the voltage can be turned down if a threshold value for the operating temperature is exceeded, for example in order to avoid damaging the lamp. The temperature measurement device and/or the control device may be part of the electric circuit on the circuit board, at least partially.

In accordance with one embodiment, housing portions that are arranged adjacently to the pin-type cooling elements may have heat dissipation openings. Heat dissipation openings can be formed for example in the housing portions laterally surrounding the arrangement of pin-type cooling elements. The heat dissipation openings assist the dissipation of heat from the heat sink device. The heat dissipation openings may be of any cross-sectional shape, for example can be formed with a triangular or hexagonal shape.

In accordance with a development, a function frame can be arranged on the housing on the front side and is configured to receive one or more function devices on the housing in a retaining manner. The function frame can be formed with laterally protruding housing portions. By way of example, the function frame has insertion elements, such that function devices can be received on the housing in a detachable (exchangeable) manner. The function devices may include a light dispersion plate or a light guide plate, for example a lens plate. Exchangeable optics may thus be arranged upstream of the lamps. The exchangeable light dispersion and/or light guide device influences the light output of the lighting device, for example in order to produce scattered light. The lens plate can be produced as a one-piece injection moulded plate from plastic. The function devices to be received on the function frame are configured for example as planar elements, which cover the entire light output region of the lighting device. With the aid of the function devices, a partial shading of the light output region can also be implemented. With the use of blue LED lights, the phosphor plate arranged in front thereof can be received on the function frame.

A bothersome effect with the use of known headlights having more than one luminaire, in particular a plurality of LED luminaires is constituted by multiple shadows, which are undesirable in particular in the case of video. The effect of the multiple shadows is reduced the greater the number of luminaires or associated optics used and the more closely these are arranged. It is optically advantageous to use a lot of luminaires, for example a lot of LED luminaires, having comparable low power rather than to use few very strong luminaires. For example, 216 LED luminaires having a maximum power of 3 W can be used. These can be operated at only approximately 1.2 W, since the light yield per watt is then much higher and less cooing power is necessary. In order to reduce the necessary cooling, it is thus advantageous to operate the LED luminaires at their efficiency maximum instead of at their maximum possible power. If a lens plate is used, a slight overlap of the optics is advantageous in order to reduce this effect even more. The use of a single lens plate additionally reduces the costs significantly.

In accordance with a development, a fastening device for detachably fastening a soft box is formed on the housing. A light-shaping device can be formed by means of the soft box.

In one embodiment, the fastening device comprises push-buttons, which are formed peripherally on the housing, in order to fasten the soft box thereto detachably. The part of the push-button without spring is preferably arranged on the housing, whereby undesirable noises are avoided, which could otherwise be caused by the spring received loosely in the push-button when the lighting device is moved. The push-buttons can be recessed at least partly in an associated indentation on the housing. This enables the lighting device to be arranged side by side as closely as possible. Additional struts/tensioning elements can be used alternatively to or in combination with the push-buttons in order to fasten the soft box to the headlight. End portions of the struts or of the tensioning elements, which protrude beyond the side wall material, in particular in an edge region of the soft box that is proximal relative to the lighting device, can engage here with associated fastening recesses, for example slits (U-profiles) on the lighting device. These protrude beyond the soft box, such that the ends of the elements can engage with a profile. The soft box, alternatively or additionally to push-buttons, may have other fastening mechanisms, for example a U-profile and/or an L-profile, which can then engage with the profile of the headlight or a speed ring. The profile may extend along the proximal edge region of the soft box. A magnetic mechanism with magnets can also be used in addition or alternatively to the fastening of the soft box.

The soft box is produced for example with side walls made of flexible material, for example made of a textile, which, on the front side of the lighting device, then surround a physical light output region on one or more sides, such that a light former is formed.

In order to brace the side walls of the soft box, flexibly bendable rod elements can be provided, which are introduced into associated receiving pockets. The receiving pockets can be formed along the extension of the respective tensioning element continuously or in an interrupted manner on the and/or in the (multi-layered) material of the side walls, for example by means of one or more seams. The receiving pockets may have tube portions and/or portions extending in a planar manner above the associated side wall. Here, portions of the rod elements proximal to the housing may be arranged in associated seats, for example slots and/or other indentations, on the housing and/or the function frame, in particular curved portions of the rod elements. A soft box formed in this way can be used not only with the lighting device described here, but also with lighting devices of other type and constitutes a soft box that can be used in a versatile manner and also provides high usability. The rod elements form a possible embodiment of tensioning elements that are received in associated receiving pockets in the side portions of the soft box made of flexible material in order to brace said soft box. The tensioning elements preferably provide a tensioning force in the area of the side walls. For example, four or eight side portions can be formed. The soft box can be foldable, together with the tensioning elements. These can then remain in the soft box, even after removal thereof.

The tensioning elements can be curved at least in the use position at the side wall portions. A curved portion of the tensioning elements, in particular a portion with an apex of the curvature, can be arranged distally or proximally in relation to the lighting device. A spring tension can be provided by means of the curvature. One or more tensioning elements can be provided per side wall portion. The tensioning elements can be arranged on the inner side of the side wall portions, that is to say on the side facing the light emission of the lighting device.

In the front region, the softbox may have adhesion means on the inner sides, for example one or more hook-and-loop elements, which are suitable for detachably fastening diffusion materials, such as textiles having different light transmission degrees.

Irrespective of the lighting device, the soft box may form an independent article in one of the aforementioned embodiments, specifically a selectively foldable light-shaping device for mounting, in particular detachable mounting, on a lighting device, for example a headlight, which in particular is suitable for shooting photos and/or recording video.

In one embodiment, a quick release closure device may be formed on the housing. The quick release closure device enables a versatile and time-saving fastening of the lighting device to any holding device, for example a post. The quick release closure device may be fastened detachably on the housing. In one embodiment, a locking device is provided, which secures the quick release closure device in a mounted position on the housing and thus locks against unintended detachment. By way of example, in the case of the locking device, a pin element engages with an associated opening, wherein the locking element is biased against a removal from the opening. In one embodiment, the quick release closure device is formed with a spherical-head coupling in order to mount the lighting device on a spherical head. The spherical-head coupling may have a detachable tensioning device in order to fasten the quick release closure device on the spherical head and detach it therefrom. The spherical head to which the spherical-head coupling couples may consist of a metal material, for example aluminium, which is selectively anodised. The surface of the spherical head is roughened at least in portions, and for example is configured as a sand-blasted surface. The spherical-head coupling, which cooperates with the spherical head, may have plastic shells in one embodiment, which are formed on the inner side with spherical shells, which clamp the spherical head when the quick release closure is tensioned. The cooperation of the metal sphere, which is roughened at the surface, and the plastic shells ensures an efficient friction fit and thus secures the relative position of spherical-head coupling and spherical head.

The quick release closure device may form an independent article in one of the explained embodiments, in particular a quick release closure device for a lighting device, for example a headlight, which is suitable in particular for shooting photos and/or recording video.

Combined with the lighting device or independently hereof, a stand element can be provided, in particular for a luminaire or headlight stand, with which a number of spherical heads are arranged fixedly or detachably on a main body extending in the longitudinal direction, and with which a mounting element for coupling to a stand or a stand system is arranged on the main body. With the aid of the stand element, a number of objects, in particular a number of lighting devices, can thus be detachably fastened simultaneously on the stand element by means of quick release closure device. In another embodiment, a plurality of quick release closure devices are arranged on the main body along the longitudinal extension, in each of which devices a spherical head can then be arranged and clamped, which is in turn received on the object to be mounted, for example a lighting device.

BRIEF DESCRIPTION

Figure 2:
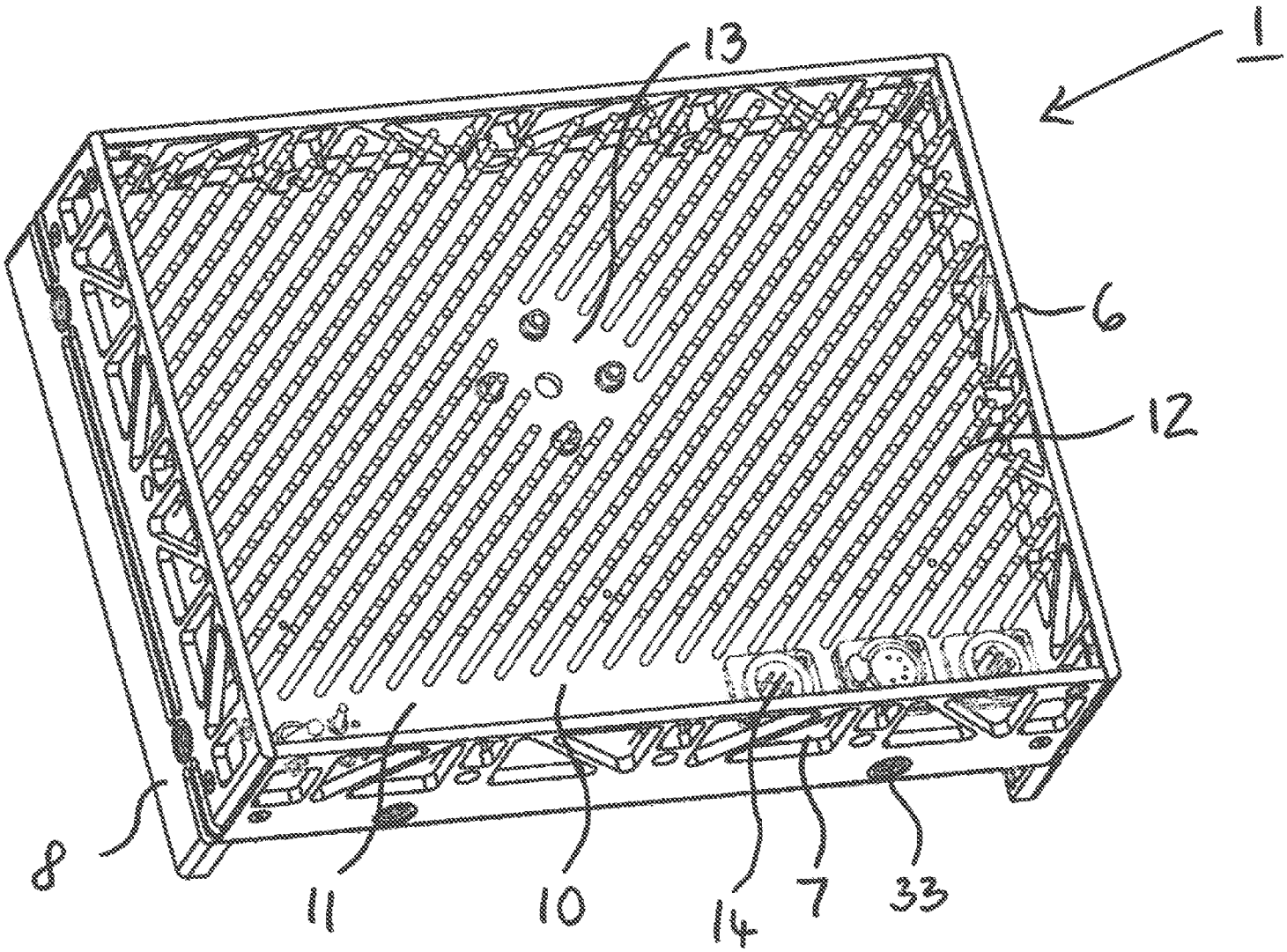
Figure 3:
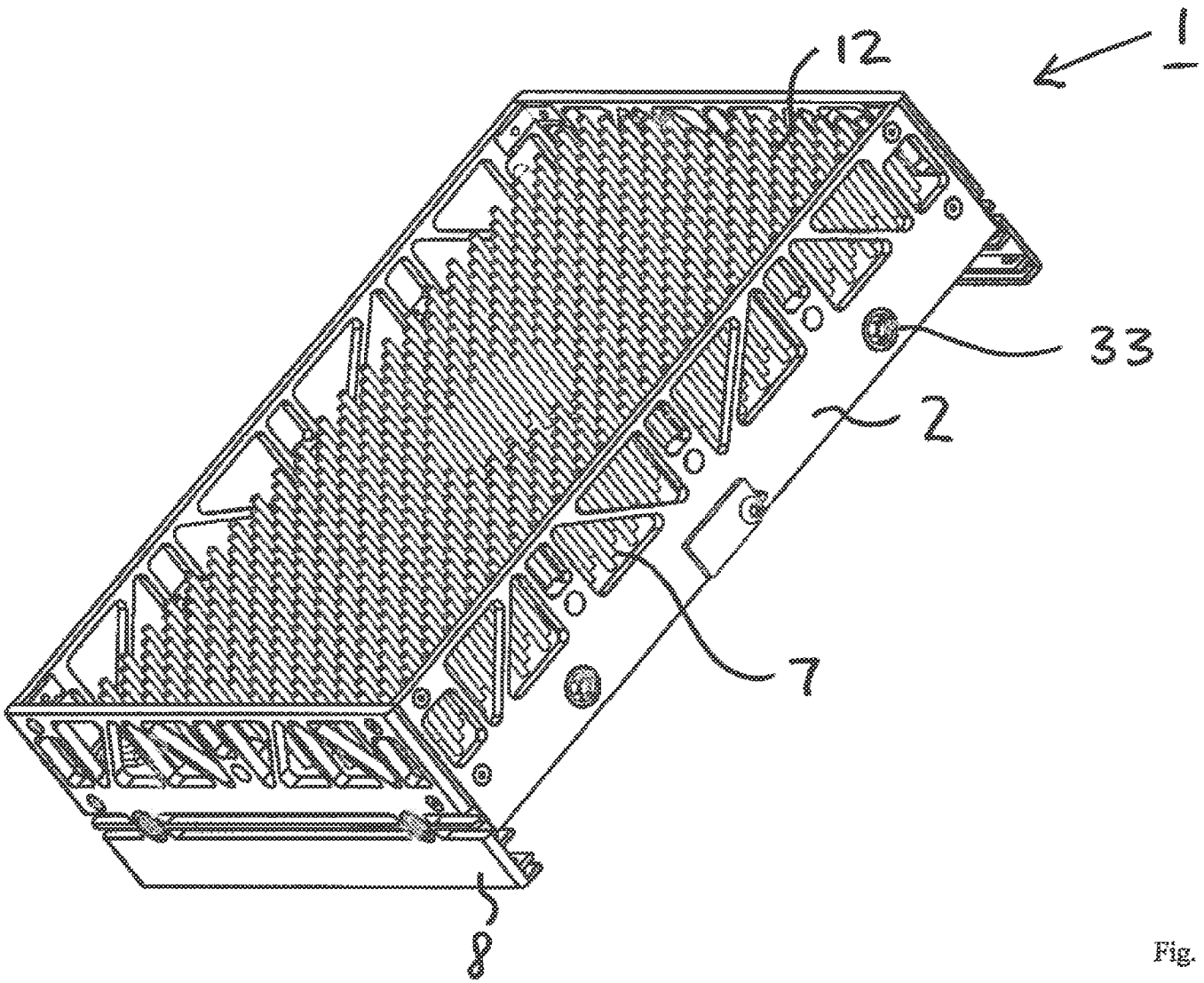
Figures 4A, 4B, 4C, 4D, 4E:
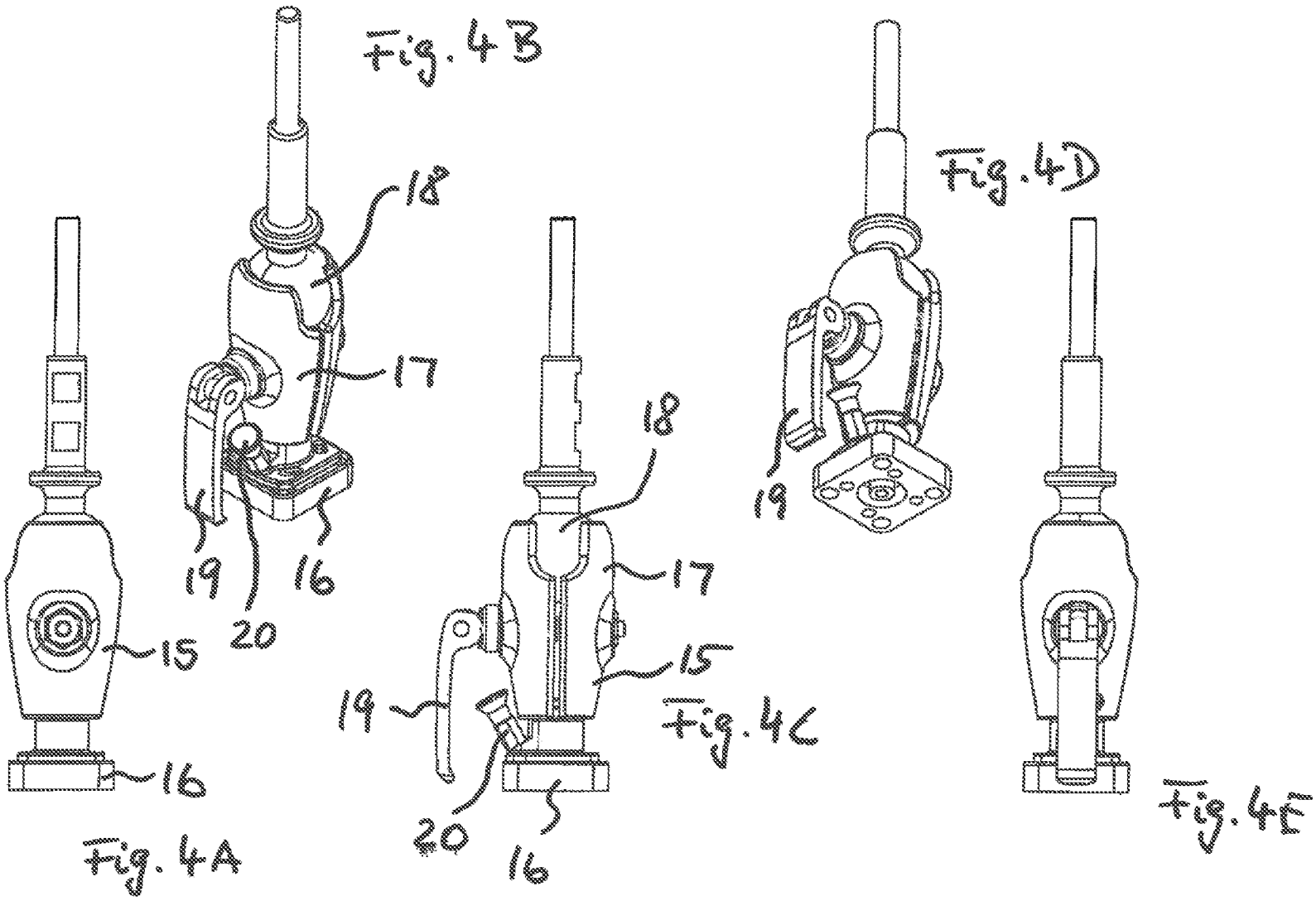
Figure 5:
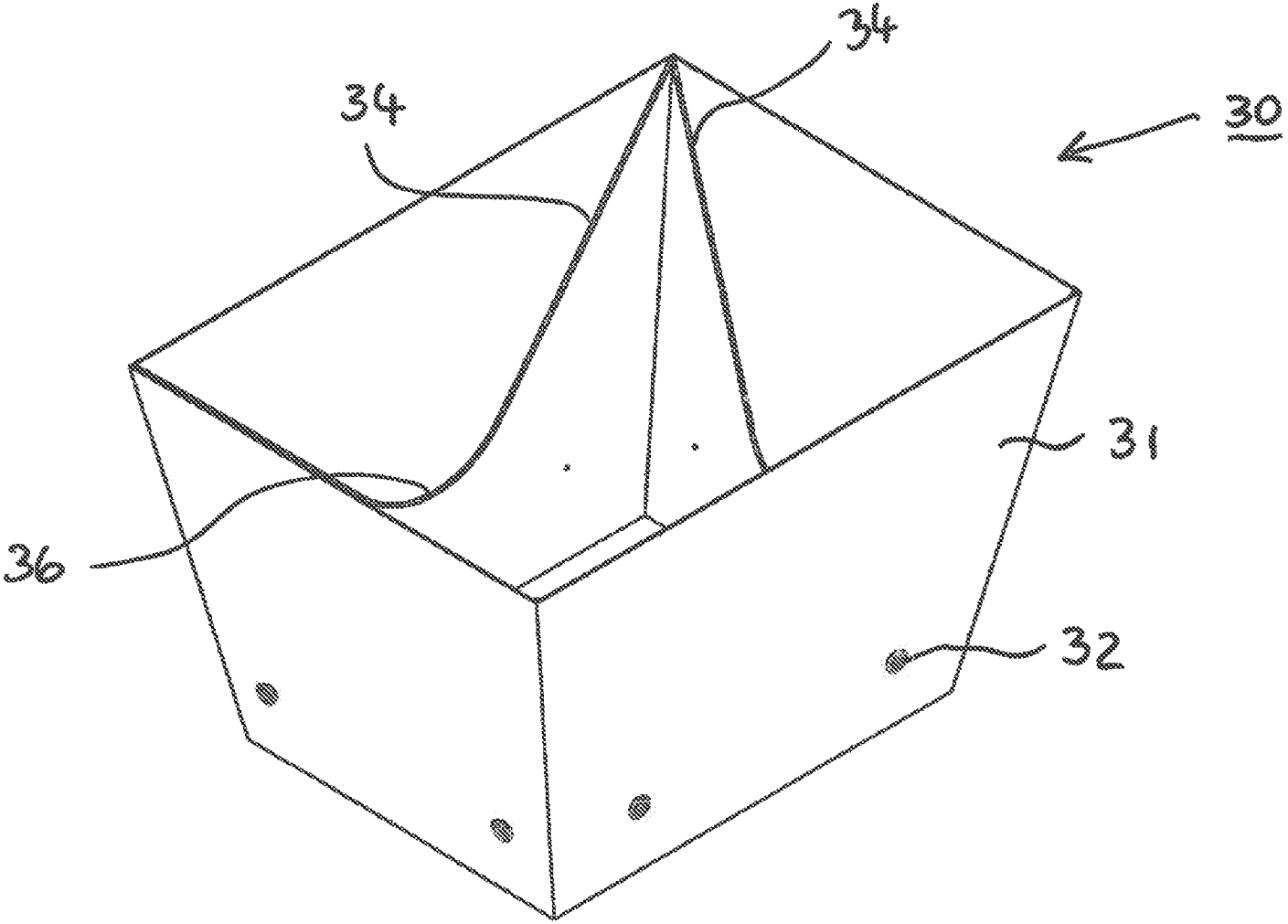
Figure 6:
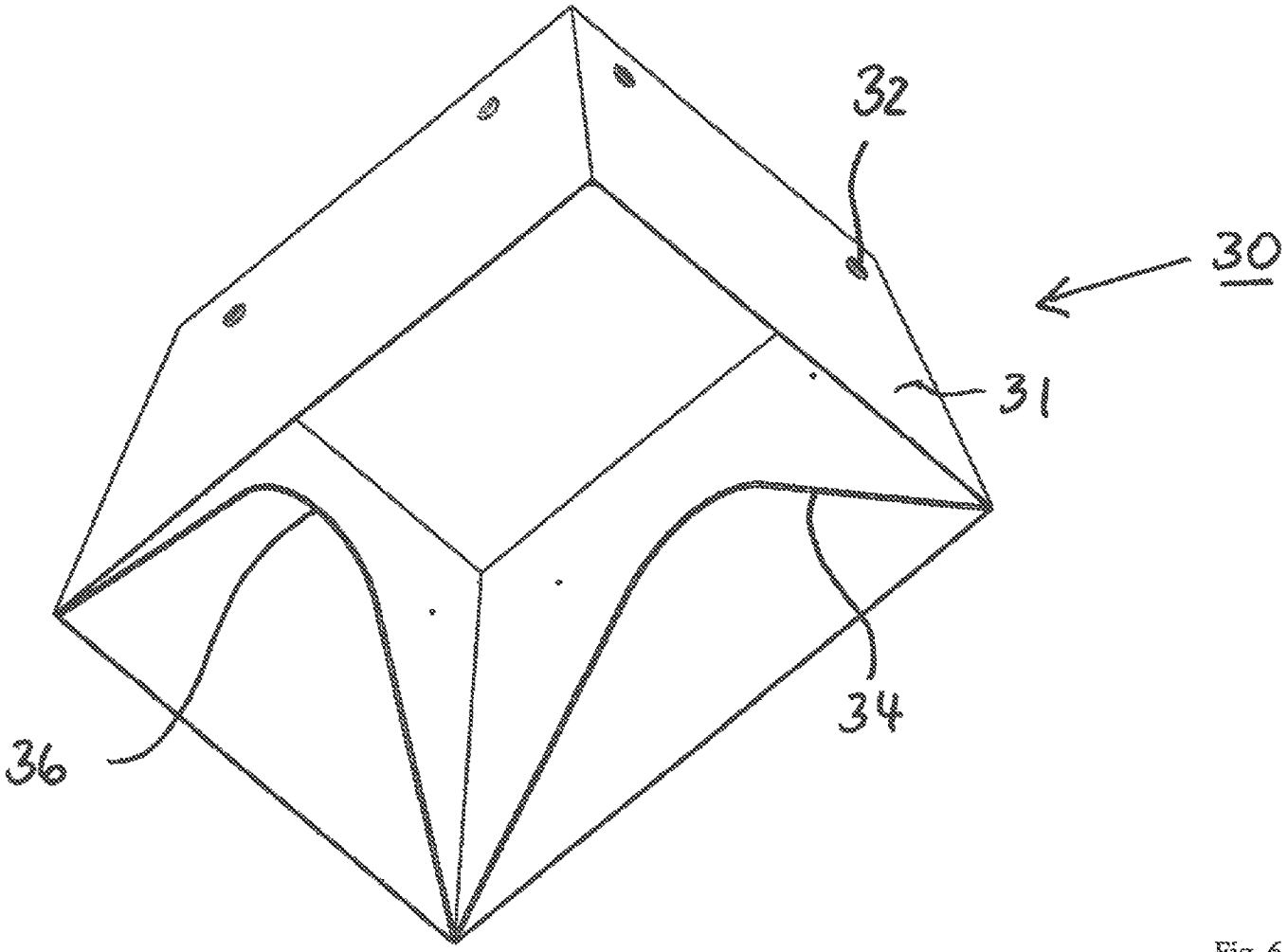
Figure 7:
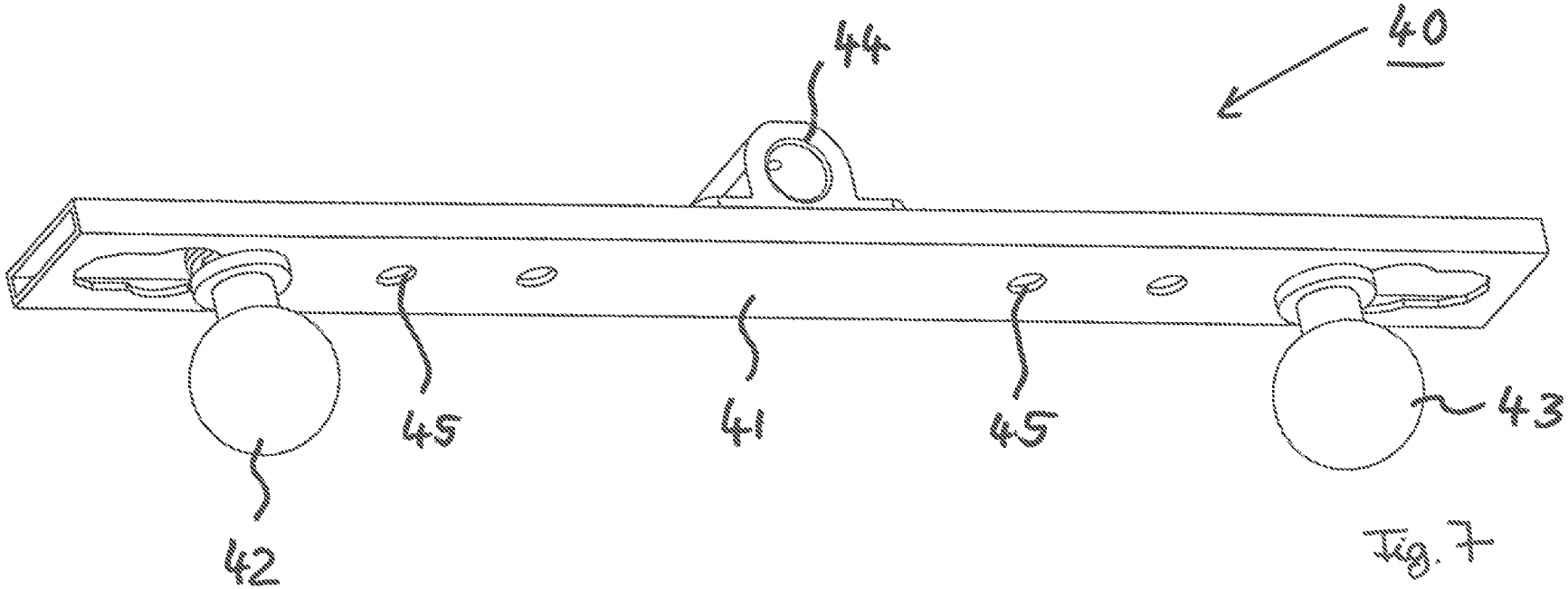
Figure 8:
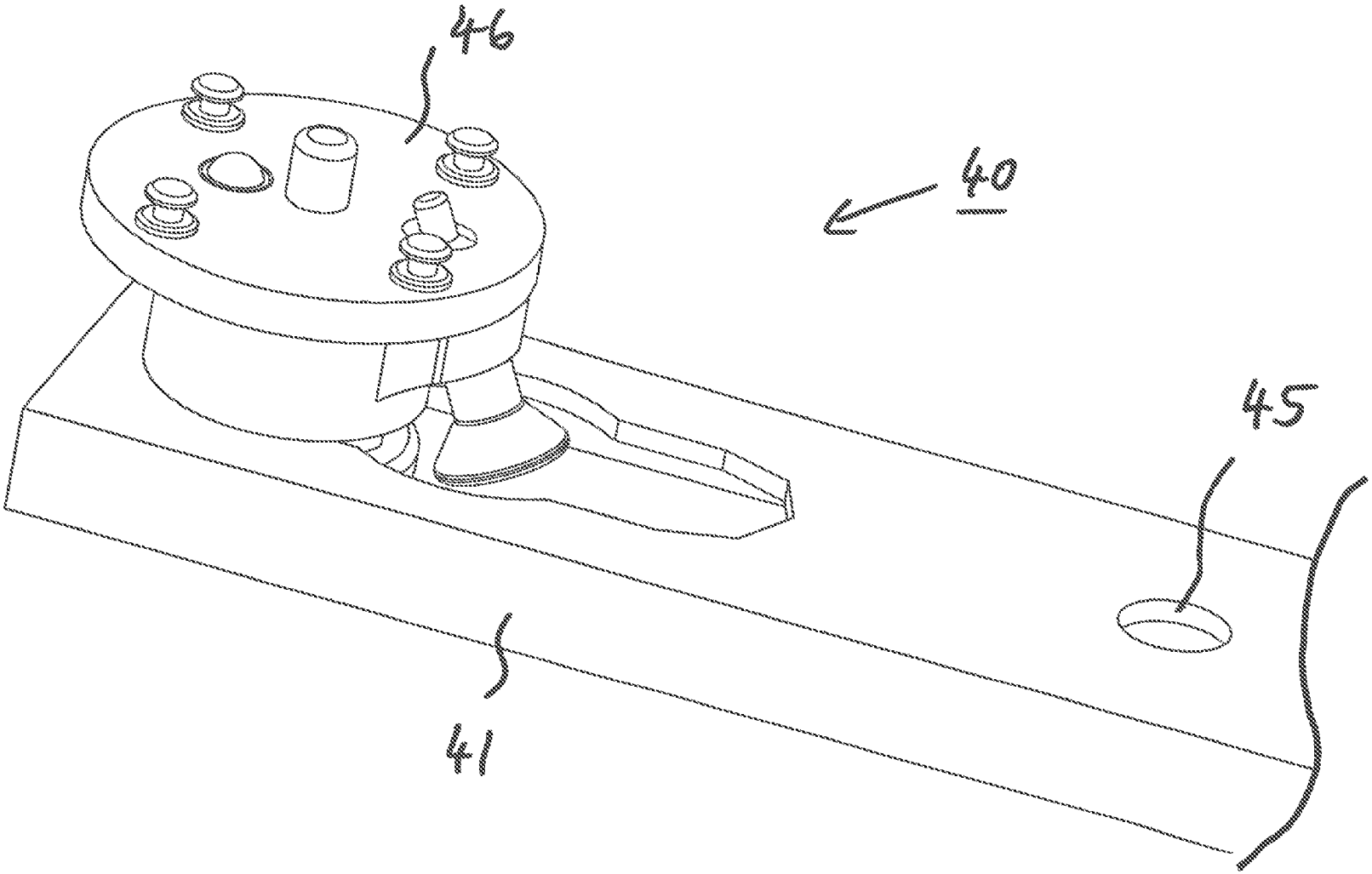

Preferred embodiments will be explained hereinafter with reference to figures of a drawing, in which:

FIG. 1 shows a perspective illustration of a lighting device from the front, FIG. 2 shows a perspective illustration of the lighting device from FIG. 1 from behind, FIG. 3 shows a further perspective illustration of the lighting device from FIG. 1 from behind, FIG. 4A to 4E show schematic illustrations of a quick release closure device, which is mounted on a spherical head FIG. 5 shows a perspective illustration of a soft box from the front, FIG. 6 shows a further perspective illustration of the soft box from FIG. 5, FIG. 7 shows a schematic illustration of a stand element having two spherical-head elements, and FIG. 8 shows a schematic illustration of a portion of a stand element with a base plate for mounting of a quick release closure device.

DETAILED DESCRIPTION

FIG. 1 shows a perspective illustration of a lighting device 1 from the front at an angle. The shown lighting device 1 is configured as a headlight for shooting photos or recording video. A plate device or arrangement 3 is received in a housing 2. A plurality of lamps 5 are fitted on a circuit board 4 arranged in the plate device 3, wherein, in the shown example, a regular arrangement is formed. The lamps 5 are LED luminaires (LED=light-emitting diode) in the shown embodiment.

The housing 2 is produced with side walls 6, in which heat dissipation openings 7 are formed. The housing 2 is made of aluminium for example, which is weight-optimising.

On the front side, a function frame 8 is formed on the housing 2 and has two mutually opposed frame parts 8*a*, 8*b*, which have guides 9 on the inner side, which are used to receive function devices (not illustrated), for example a lens plate and/or a dispersion plate.

A circuit arrangement is provided on the circuit board 4 and provides the electric circuit for the lamps 5.

FIGS. 2 and 3 show perspective illustrations of the lighting device 1 from behind at an angle. A heat sink device 10 with a base plate 11 and also an arrangement of pin-type body elements 12 is formed, which is used to dissipate the heat produced during operation of the lamps 5. The arrangement of pin-type body elements 12 is delimited laterally by the side walls 6. In the shown embodiment the pin-type body elements 12 are arranged on the rear side of the base plate 11 in accordance with a regular arrangement. The pin-type body elements 12 can be fastened to the base plate 11 with the aid of different connection techniques, including welding, soldering, press-fitting and/or adhesive bonding.

In the shown embodiment the base plate 11 is formed with the aid of the circuit board 4 as part of the plate device 3. At the same time, the plate device 3 together with the circuit board 4 serves as a rear wall of the housing 2.

As can best be seen from FIG. 2, a seat 13 is integrated into the arrangement of cooling pin-type elements 12 so as to detachably mount a quick release closure device 14 in said seat, said quick release closure device being shown in FIGS. 4*a* to 4*e*.

According to FIG. 2 connection devices 14 are provided, for example in order to connect an energy supply and/or data or control line connections.

FIG. 4A to 4E show various illustrations of a quick release closure device 15 with a main plate 16, on which a quick release closure 17 is arranged, which, in the shown embodiment, is mounted on a spherical head 18. The quick release closure 17 has a tensioning device 19 in order to open and to close the quick release closure 17. A locking device 20 is provided on the main plate 16 and locks the quick release closure device 15 against an unintended release when the main plate 16 is mounted in the region of the seat 13. To this end, a biased pin engages with an associated seat.

FIGS. 5 and 6 each show a perspective illustration of a soft box 30, which has fastening means 32 in the region of side walls 31, which fastening means are used for push-button fastening to associated fastening means 33 on the housing 2 (see FIGS. 1 to 3). Tensioning elements 34 are provided in the side walls 32 and are formed with the aid of flexible rods, which are in turn received in associated receiving pockets or tabs on the side walls 31 made of flexible material, for example a textile material. Curved portions 36 of the tensioning elements 34 are arranged in a proximal region. Alternatively, the curved portions 36 can also be arranged in the distal region of the side walls 31 (not illustrated). In particular with such an embodiment, end portions of the tensioning elements 34 can protrude beyond the lighting device and can engage with associated recesses on the lighting device when the soft box 30 is fastened.

In the embodiment shown by way of example, four side walls 31 are provided with the associated tensioning elements 34. In other embodiments, a greater number of side walls may also be provided, for example eight partial side walls, which are formed on the soft box around the opening and which are each assigned a tensioning element in a comparable manner. With a square opening of the soft box, two partial side walls can thus be arranged on each of all four sides.

It is clear from FIG. 1 that the function frame 8 has slits 35, with which the curved portions 36 of the tensioning elements 34 engage when the soft box 30 is fitted on the housing 2.

FIGS. 7 and 8 show schematic illustrations of a stand element 40 having a base body 41, on which two spherical-head elements 42, 43 are detachably mounted. Furthermore, a mounting element 44 is arranged on the base body 41, by means of which mounting element the stand element 40 can be mounted on a stand system, for example by being plugged on. The spherical-head elements 42, 43 can be used to detachably mount objects thereon, for example lighting devices, by means of the above-described quick release closure device. Additional apertures 45 are formed in the main body 41 and can also be used to receive the spherical-head elements 42, 43, such that these can be mounted along the base body 41 in various positions.

FIG. 8 shows an embodiment of the stand element 40, in which, in contrast to the illustration in FIG. 5, a mounting base or plate 46 is arranged on the base body 41 and can be used to mount a cutting closure device (see FIGS. 4A to 4E). The stand elements 40 shown in FIGS. 7 and 8 make it possible to mount a plurality of objects, in particular lighting devices, on a stand system. The spherical-head connection supports a flexible adjustability of the physical orientation of the detachably mounted objects.

The features of the invention disclosed in the above description, the drawing and the claims can be of significance both individually and in any combination for the implementation of the invention in the various embodiments thereof.

The claims are as follows:

1. A lighting device, comprising a housing;

a planar arrangement of lamps, which are arranged in the housing; and a plate device, wherein a housing rear wall is formed by the plate device, the plate device being a circuit board, on which an electric circuit associated with the lamps is arranged, and a heat sink device for passive cooling, comprising pin-shaped cooling elements; and a seat integrated into an arrangement of the pin-shaped cooling elements configured to detachably mount a release closure device in the seat, the seat being located at a surface region of a rear side of the circuit board that is without the pin-shaped elements arranged directly thereon, wherein the surface region is surrounded by the pin-shaped cooling elements and directly engages the release closure device when the release closure device is mounted to the lighting device;

wherein the pin-shaped cooling elements are arranged directly on the rear side of the circuit board, such that the pin-shaped cooling elements are thermally coupled to a cooling core of the circuit board;

wherein the release closure device is formed with a spherical-head coupling in order to mount the lighting device on a spherical head and has a locking device that locks against unintended detachment;

wherein the spherical-head coupling has a tensioning device in order to fasten the release closure device on the spherical head and detach the release closure device therefrom;

wherein the housing comprises housing portions laterally surrounding the arrangement of the pin-shaped cooling elements, wherein the housing portions comprise heat dissipation openings;

wherein the housing is arranged such that the pin-shaped cooling elements are unshielded by housing parts with respect to the surrounding environment on the rear side of the housing.

2. The lighting device according to claim 1, wherein each of the lamps is an LED luminaire.

3. The lighting device according to claim 1, wherein the pin-shaped cooling elements are configured in accordance with at least one of the following designs: adhesively bonded pin-shaped elements, welded pin-shaped elements, soldered pin-shaped elements and press-fitted pin-shaped elements.

4. The lighting device according to claim 1, wherein the cooling core is made of metal.

5. The lighting device according to claim 1, wherein the arrangement of lamps is configured to output light having a colour rendering index of at least 90.

6. The lighting device according to claim 1, wherein the arrangement of lamps is assigned a dimming device configured to dim the lamps.

7. The lighting device according to claim 1, wherein the arrangement of lamps is assigned a temperature measurement device, with which an operating temperature of the lamps is measured.

8. The lighting device according to claim 1, wherein a function frame is arranged on a front side of the housing and is configured to receive and retain one or more function devices on the housing.

9. The lighting device according to claim 1, wherein a fastening device for detachably fastening a soft box is formed on the housing.

10. The lighting device according to claim 1, wherein the release closure device is formed on the housing.

11. The lighting device according to claim 1, wherein the arrangement of lamps is configured to output light having a colour rendering index of at least 95.

* * * * *